US007015641B2

(12) United States Patent
Tucker

(10) Patent No.: US 7,015,641 B2
(45) Date of Patent: Mar. 21, 2006

(54) REDUCED VEILING GLARE CATHODE WINDOW

(75) Inventor: Jay Scott Tucker, Chandler, AZ (US)

(73) Assignee: Litton Systems, Inc., Los Angeles, CA (US)

( * ) Notice: Subject to any disclaimer, the term of this patent is extended or adjusted under 35 U.S.C. 154(b) by 0 days.

(21) Appl. No.: 10/708,886

(22) Filed: Mar. 30, 2004

(65) Prior Publication Data

US 2004/0198192 A1 Oct. 7, 2004

Related U.S. Application Data

(60) Provisional application No. 60/320,068, filed on Mar. 30, 2003.

(51) Int. Cl.
*H01J 43/28* (2006.01)

(52) U.S. Cl. ..... 313/534; 313/524; 313/541; 313/544; 313/104; 313/105 CM; 445/46

(58) Field of Classification Search ..... 313/524, 313/528, 541–544, 104, 105 CM, 534; 445/46
See application file for complete search history.

(56) References Cited

U.S. PATENT DOCUMENTS

| | | | | |
|---|---|---|---|---|
| 4,393,322 | A | 7/1983 | Siegmund | 313/544 |
| 4,414,009 | A * | 11/1983 | Siegmund | 65/409 |
| 4,661,079 | A | 4/1987 | Harris et al. | 313/524 X |
| 4,760,307 | A * | 7/1988 | Howorth | 313/371 |
| 4,961,025 | A | 10/1990 | Thomas et al. | 313/524 |
| 5,023,511 | A * | 6/1991 | Phillips | 313/524 |
| 5,045,510 | A * | 9/1991 | Kohli et al. | 501/66 |
| 5,078,773 | A * | 1/1992 | Thomas | 65/37 |
| 6,040,657 | A | 3/2000 | Vrescak et al. | 313/544 |
| 6,146,229 | A | 11/2000 | Smith et al. | 445/46 |

* cited by examiner

*Primary Examiner*—Karabi Guharay
*Assistant Examiner*—Sikha Roy
(74) *Attorney, Agent, or Firm*—Marsteller & Associates, P.C.

(57) ABSTRACT

A faceplate (F) for an image intensifier tube (10) for reducing veiling glare begins as a blank (36) of optical material of a desired glass composition having a shape that conforms substantially to a configuration of the faceplate (F) to be produced. An extraneous removable aperture step portion (54) is formed on the glass blank (36). The glass blank is blackened (41) and the aperture step portion (54) is removed creating a desired transmissive aperture (34) through the glass blank (36).

3 Claims, 8 Drawing Sheets

REDUCED VEILING GLARE CATHODE WINDOW

CROSS REFERENCE TO RELATED APPLICATIONS

This application claims the benefit of U.S. Provisional Application Ser. No. 60/320,068, filed Mar. 30, 2003, entitled REDUCED VEILING GLARE CATHODE WINDOW.

BACKGROUND OF INVENTION

1. Technical Field

The invention relates to the field of image intensifier tubes, and more particularly, to an image intensifier tube photocathode having reduced veiling glare.

2. Background Art

Image intensifier tubes are used generally in viewing devices for amplifying light and forming an image. Image intensifier tubes are known to suffer from a problem known as stray light or "veiling glare."

There are three primary known methods for providing an aperture for the image intensifier tube: Method 1 uses a chrome mask deposited over the active cathode surface, Method 2 uses an external mask assembled on the potted tube housing or on the objective lens of the system, and Method 3 restricts the shape of the cathode window to two parallel surfaces.

Method 1 requires that a precision chrome layer be deposited over the finished cathode assembly, and this adds process time and handling. Any mismatch of the precision mask and the cathode surface will allow for reflections off the chrome surface that severely degrade veiling glare performance.

Method 2 requires that a precision "glare shield" be mounted onto the face of the image intensifier or on an element in the objective lens cell. Because an aperture needs to be very thin to avoid contributing additional reflections to the image "glare shields" are often expensive to fabricate and difficult to assemble on the respective lens element.

Method 3 requires that the cathode window be in the shape of a disc with two parallel surfaces. Because the cathode window provides mechanical as well as optical properties to the image tube this method greatly restricts the design of the device. Additionally this method is primarily for reducing veiling glare and does not provide an aperture as in the present invention.

The known designs for providing the correct aperture and reducing veiling glare use a combination of the above methods. Method 1 provides an adequate aperture for the image tube, but does not provide any glare reduction and can actually make internal reflections worse. Method 2 provides an aperture for the image tube, but only provides partial reduction to internal reflections and may actually create additional reflections at the lens interface. Method 3 only provides for a reduction in veiling glare and also limits the design options.

U.S. Pat. Nos. 4,661,079 and 4,961,025 disclose window-blackening methods. Removal of the prior blackening layer exposes the full diameter of the photocathode because of the lack of the aperture step of the present invention. Similarly, the surface of the photocathode is uniformly blackened because there is no aperture step of the present invention.

U.S. Pat. No. 6,040,657 teaches parallel window surfaces to reduce veiling glare.

While the above cited references introduce and disclose a number of noteworthy advances and technological improvements within the art, none completely fulfills the specific objectives achieved by this invention.

SUMMARY OF INVENTION

In accordance with the present invention, a faceplate for an image intensifier tube for reducing veiling glare begins as a blank of optical material of a desired glass composition having a shape that conforms substantially to a configuration of the faceplate to be produced. An extraneous removable aperture portion is formed on the glass blank. The glass blank is blackened and the aperture portion is removed creating a desired transmissive aperture through the glass blank.

These and other objects, advantages and features of this invention will be apparent from the following description taken with reference to the accompanying drawings, wherein is shown the preferred embodiments of the invention.

BRIEF DESCRIPTION OF DRAWINGS

A more particular description of the invention briefly summarized above is available from the exemplary embodiments illustrated in the drawings and discussed in further detail below. Through this reference, it can be seen how the above cited features, as well as others that will become apparent, are obtained and can be understood in detail. The drawings nevertheless illustrate only typical, preferred embodiments of the invention and are not to be considered limiting of its scope as the invention may admit to other equally effective embodiments.

DETAILED DESCRIPTION

So that the manner in which the above recited features, advantages, and objects of the present invention are attained can be understood in detail, more particular description of the invention, briefly summarized above, may be had by reference to the embodiment thereof that is illustrated in the appended drawings. In all the drawings, identical numbers represent the same elements.

Figure 1:
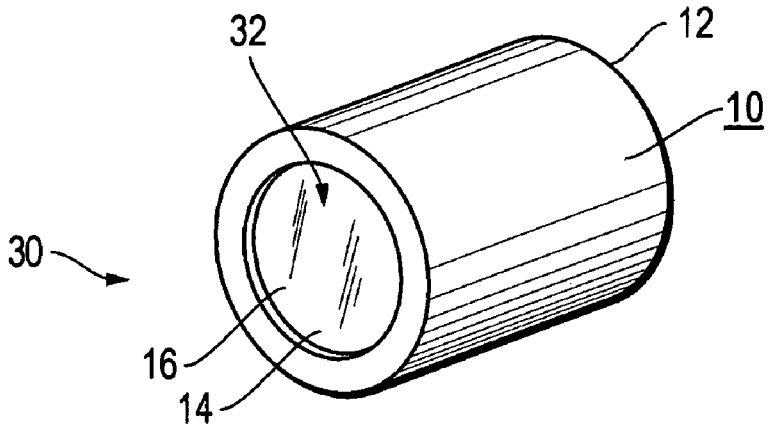
FIG. 1 is a perspective plan view of a known image intensifier tube.

FIG. 1 depicts a simplified perspective view of a known image intensifier tube 10. The image intensifier tube 10 includes a cylindrical housing 12 in which is located a front face plate 14 made of optical material which is arranged to receive and transmit light. The face plate 14 is normally sealed within the housing 12 and is surrounded by a peripheral flange 16. Light rays 30 from the field of view penetrate the face plate 14 and are directed to the electronics, not shown, of the image intensifier where the number of electrons is amplified.

Figure 2:
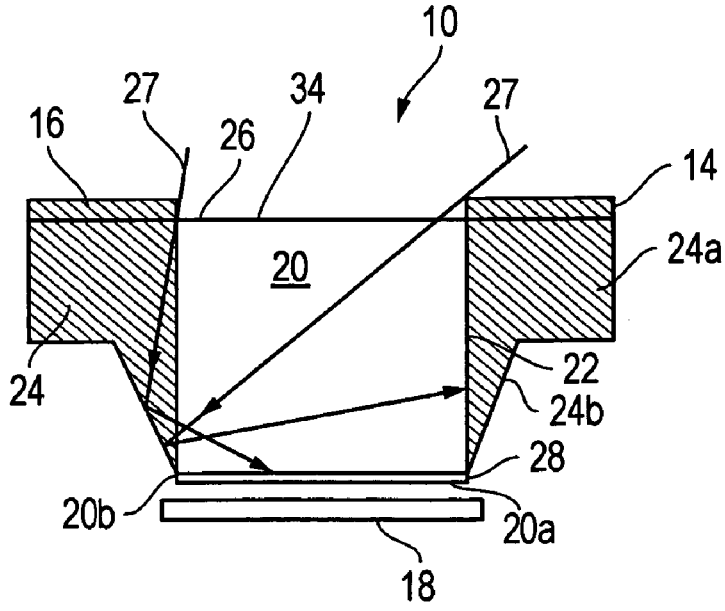
FIG. 2 (Prior Art)
FIG. 2 is a cross-sectional view of a prior art glass face plate with a ring of black glass.
Figure 3:
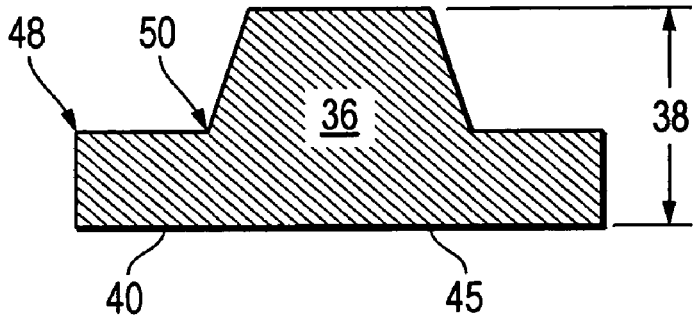
FIG. 3 (Prior Art)
FIG. 3 is a cross section view of a prior art glass blank without an aperture step.
Figure 4:
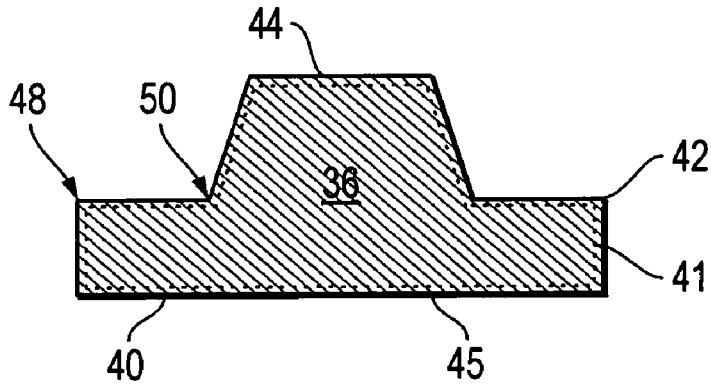
FIG. 4 (Prior Art)
FIG. 4 is a cross section view of a prior art blackened window without an integrated aperture.
Figure 5:
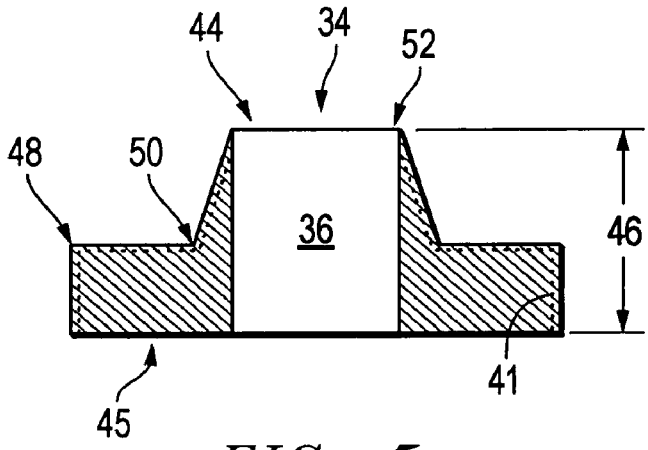
FIG. 5 (Prior Art)
FIG. 5 is a cross section view of a prior art window with blackening removed to create a clear aperture.

In FIG. 2, the known image intensifier tube 10 generally comprises three basic components: the face plate assembly 14, which functions as a cathode; a face plate, not illustrated, which functions as an anode; and a known microchannel plate (MCP) 18 spaced from the face plate 14. Both the cathode and anode face plates are preferably formed from glass of high optical quality. The microchannel plate is also formed of a glass material which possesses a secondary emissive property and conductive characteristics. The microchannel plate 18 is mounted in the image tube with both its input and output faces parallel to the image tube cathode face plate 14 and a phosphorous screen, charge coupled device (CCD), or similar viewing forming element associated with the anode face plate.

As a necessary step in the manufacture of image intensifiers 10 the crystal assembly containing the photocathode is sealed to a glass window 32 to form the face plate assembly 14. This window 32 serves as a mount for the thin fragile crystal, which could not provide the mechanical strength required to initiate a vacuum seal. Additionally the window 32 must provide optical characteristics to transfer light 30 to the cathode surface and to minimize reflections observed as noise in the image produced by the image intensifier tube 10.

Generally, the face plate 14 includes a central, generally circular body portion 20. Prior to the present invention a ring of black glass 24 may have been positioned on an outer surface 22 of the body portion 20. The black glass may have a sill 24*a* created in the form of a flange surrounding a portion of the outer surface 22. The black glass 24 has a reduced thickness in the area of sloping surfaces 24*b* and ends above an end surface 20*a* of the body portion 20 to permit the bonding of a photoemissive wafer or other suitable image forming device 28 to the end surface 20*a*. This leaves an area 20*b* with no surrounding black glass forming an aperture 34.

FIG. 2 further shows the prior art face plate 14 with the black glass 24 surrounding most of the surface 22. Incoming light rays 27 which are outside the normal field of view enter the faceplate through a surface 26 exposed by an opening formed in the peripheral flange 16. The light rays 27 pass into the black glass 24 and because of the transmissiveness of the glass 24 are reflected back into the faceplate and are reflected to the surface 20*a* and transmitted to the photoemissive wafer 28. The amount of stray light remaining in the faceplate and directed to the surface 20*a* is in the range of greater than 0.8% depending on how poor the cathode is bonded in the faceplate assembly 14.

Figure 7:
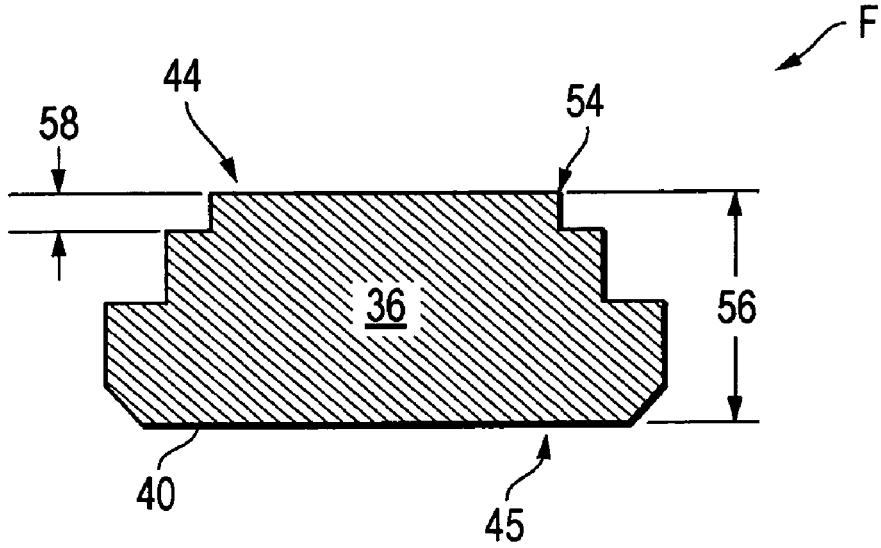
FIG. 7 is a cross section view of a glass blank with the aperture step of the present invention.
Figure 8:
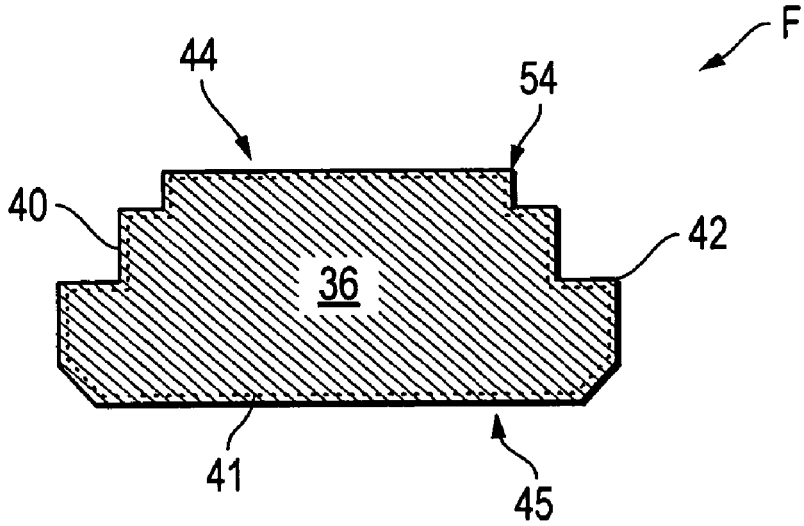
FIG. 8 is a cross section view of a blackened window with the integrated aperture of the present invention.

A requirement of the light transferred to the cathode is that it be limited to only the useable area of the device so that spurious edge emissions and edge glow are minimized. Prior art methods use the chrome layer described in Method 1 above to provide this necessary aperture 34. Problems associated with precision coating procedures and the risk of exposed chrome causing internal reflections is eliminated by the present invention. The present invention integrates the aperture 34 directly into the window material, which is absorbing rather than reflecting. See particularly FIGS. 7 and 8.

Referring now to FIGS. 3 through 6 another known technique is shown involving a "blackening" step of the glass blank 36 generally formed to a desired shape. The glass blank 36 has an initial thickness 38. A known blackening process is applied to the external surface 40 of the glass blank 36. The blackening effect or agent 41 penetrates the outer surface 40 of the glass blank 36 to a distance 42 beneath the outer surface 40 forming a completely blackened window blank. See FIG. 4. The blackened portion of the glass blank 36 substantially blocks the transmission of light therethrough.

Portions containing each of the blackening of the top face 44 and the bottom face 45 are ground away or otherwise removed exposing the transmissive glass having a resulting thickness 46 that is less than the initial thickness 38 of the glass blank 36. Thus, a clear aperture 34 is formed in the top surface 44 of the blackened glass blank 36.

Figure 6:
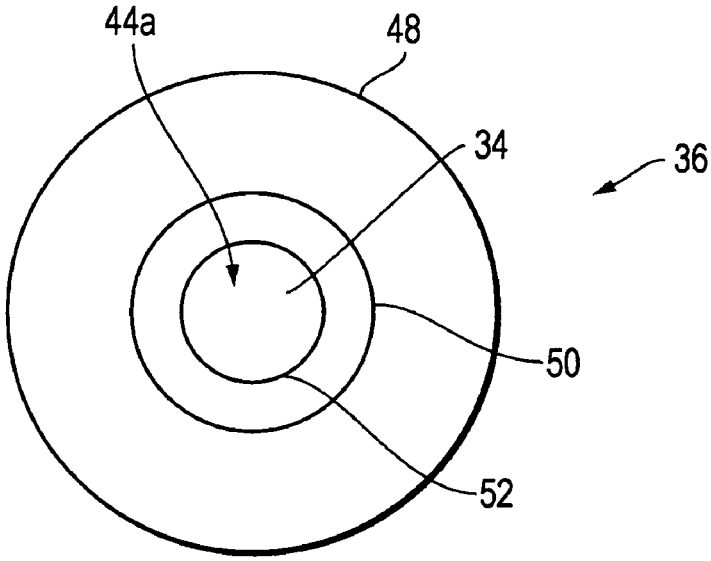
FIG. 6 (Prior Art)
FIG. 6 is a top view of FIG. 5.

FIG. 6 depicts a top view of the prior blackened glass blank with the outer, step and aperture edges 48, 50, and 52 respectively.

Referring now particularly to FIGS. 7 through 10, in the present invention, an annular aperture step portion 54 is first ground into the upper surface 44 of a glass blank 36 before the known step of blackening. Often, but not necessarily, the initial thickness 56 of the glass blank 36 used in the present invention is thicker than that of the prior glass blanks used in the previously described blackening process. The greater thickness 56 is generally due to the thickness 58 of the annular aperture step layer or segment 54.

The faceplate F for an image intensifier tube 10 for reducing veiling glare begins as a blank of optical material of a desired glass composition having a shape that conforms substantially to a configuration of the faceplate to be produced. An extraneous removable annular aperture step portion is formed in the upper surface 44 of the glass blank 36 as the aperture step 54. The glass blank 36 s formed having both an upper surface 44 and complementary opposing bottom face or surface 45. The exterior surface of the glass blank 36 is then blackened using a known and desired technique. Similar to that described above, the blackening effect or agent 41 penetrates the outer surface 40 of the glass blank 36 to a distance 42 beneath the outer surface 40 forming a completely blackened window blank. See FIG. 8.

Then at least a portion of the aperture step 54 and the bottom face surface 45 are ground away or otherwise removed exposing the transmissive glass and creating a desired transmissive or clear aperture 34 through the glass blank 36. Generally, the complete thickness 58 of the aperture step portion 54 is removed.

The resulting thickness 60 after the step and bottom portions are removed is less than the initial thickness 56 of the glass blank 36. Thus, a clear aperture 34 is formed in the top surface 44 of the blackened glass blank 36.

The processed upper surface 44*a* and the bottom or lower surface 45 after it has been processed desirably form parallel and flat surfaces in order to reduce undesired optical reflections or refractions of the incoming light 30.

Figure 10:
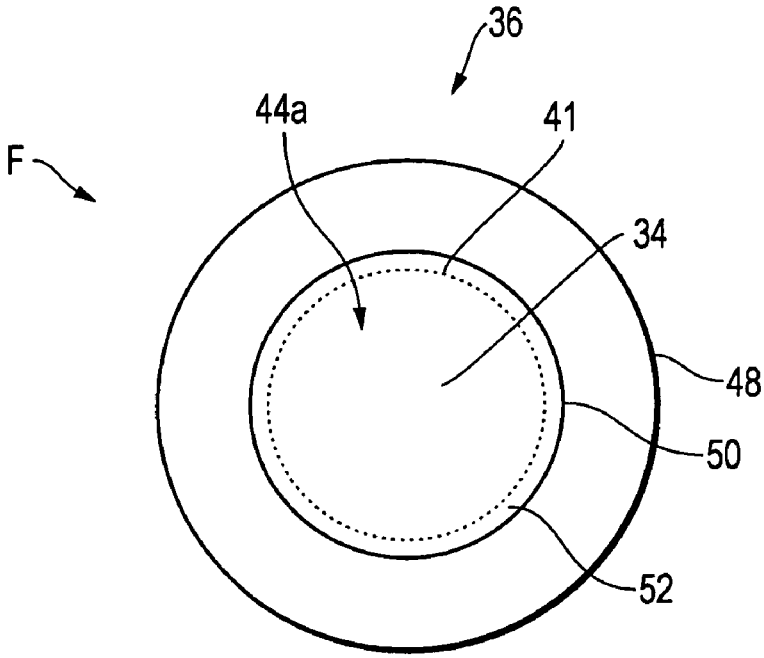
FIG. 10 is a top view of FIG. 9.

FIG. 10 depicts a top view of the prior blackened glass blank with the outer, step and aperture edges 48, 50, and 52 respectively. FIG. 10 shows how the present invention differs from previous techniques in that the resulting upper surface 44*a* includes the aperture 34 is bound by a blackened ring surface as compared to the resulting surface 44*a* of the prior technique including only the aperture 34.

Figure 9:
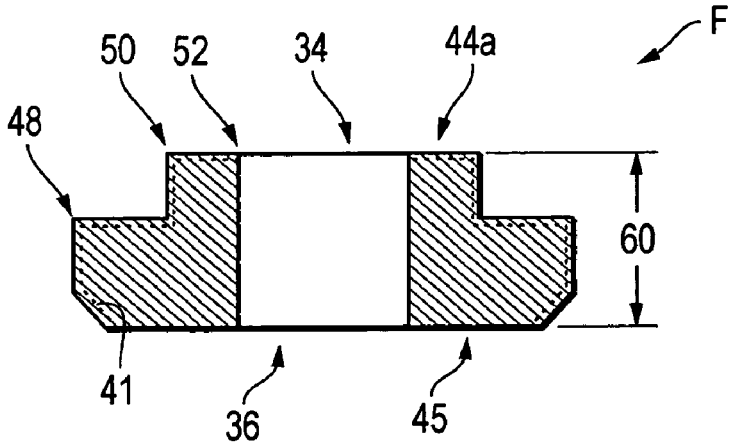
FIG. 9 is a cross section view of a window with the integrated aperture with blackening removed to create a clear aperture.

Referring to FIGS. 9 and 10, the aperture step 54 is completely removed after blackening. The desired aperture geometry remains after the aperture step 54 is removed.

Figure 11:
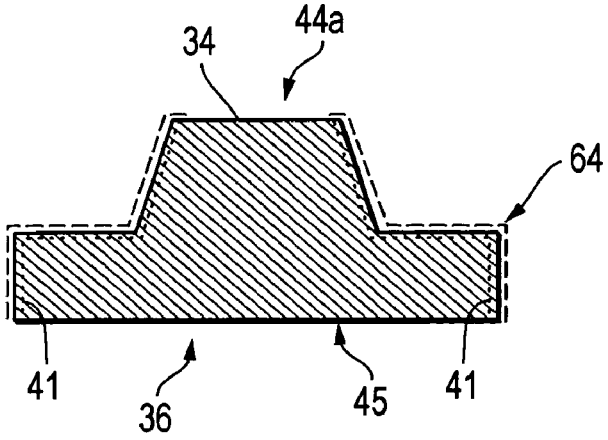
FIG. 11 (Prior Art)
FIG. 11 is a cross section view of a prior art window with blackening removed and required conductive coating applied.

Minimizing internal reflections is a critical requirement of the cathode window assembly, but prior art has not provided a single solution that meets all of the optical and mechanical design considerations. For example, windows with large stepped slopes tend to provide better formats for an aperture, but also lead to internal reflections degrading veiling glare performance. See FIGS. 11 and 12. Conversely widows with parallel faces tend to reduce internal reflections, but are highly restricted for design variations.

Referring now to FIGS. 11 through 15, a conductive coating 64 may be applied to or mounted with desired exterior surfaces of the glass blank 36. Preferably the conductive coating 64 does not cover the bottom surface 45 nor does it cover the aperture 34 Chrome apertures and external glare shields 66 (see FIG. 15) may be used to reduce veiling glare for image intensifier tubes 10.

Figure 12:
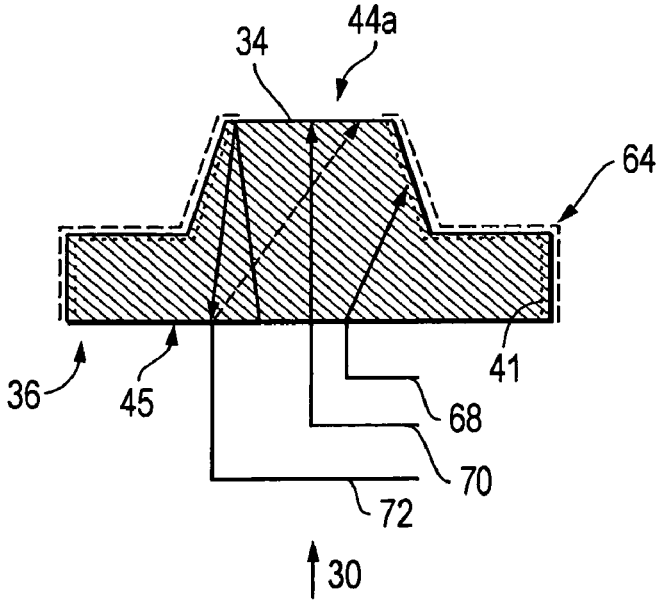
FIG. 12 (Prior Art)
FIG. 12 is a cross section view of a prior art window and resulting veiling glare being shown.
Figure 13:
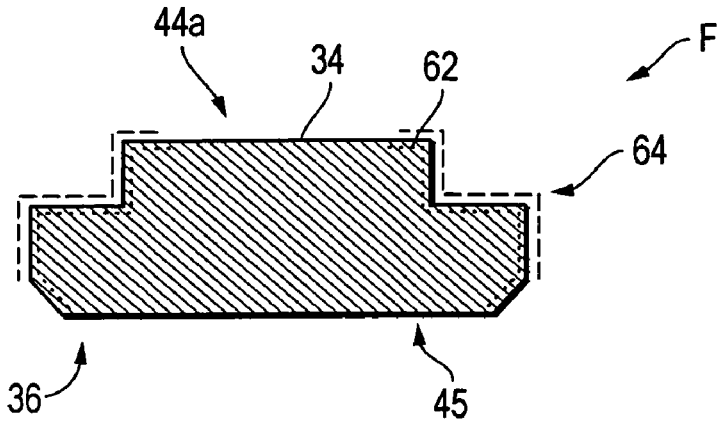
FIG. 13 is a cross section view of a window with the integrated step of the present invention including blackening removed and required conductive coating applied.
Figure 14:
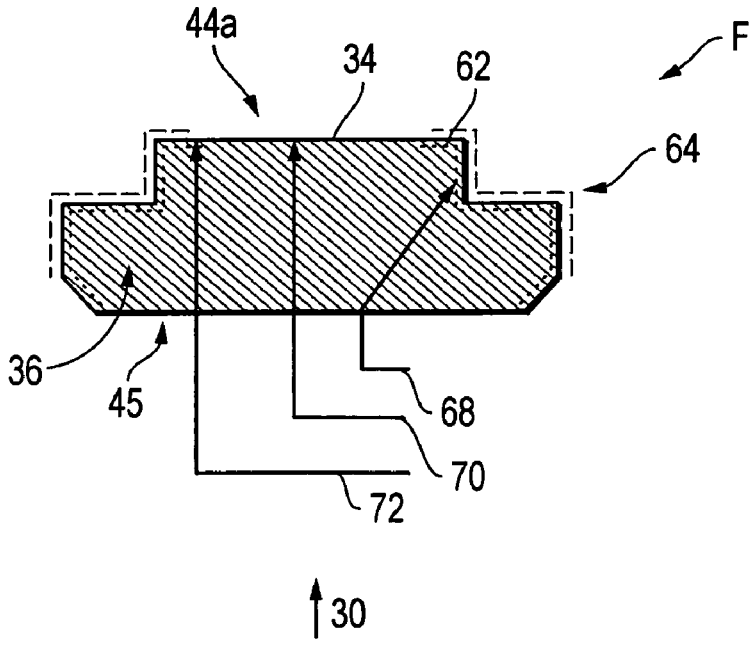
FIG. 14 is a cross section view of a window with the integrated step of the present invention and resulting reduction in veiling glare being shown.
Figure 15:
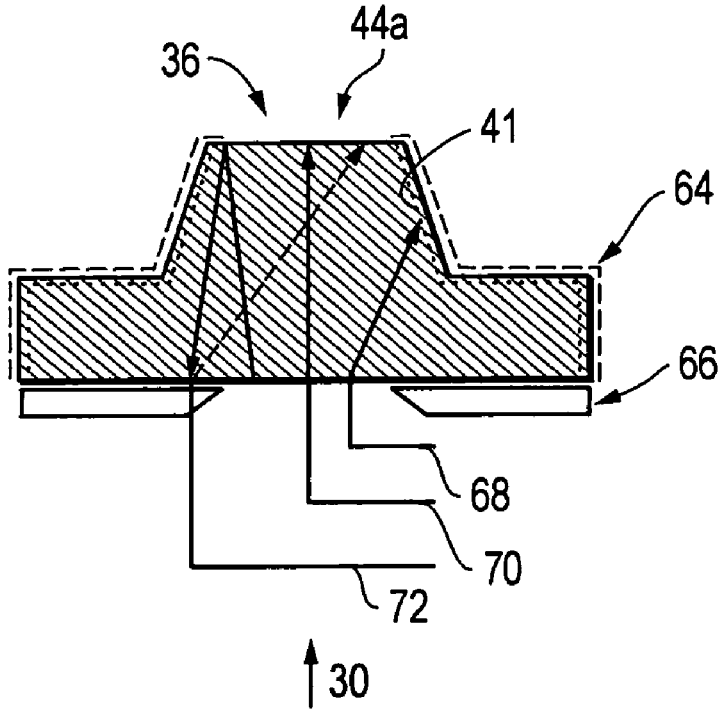
FIG. 15 (Prior Art)
FIG. 15 is a cross section view of a prior art window with a precision glare shield and resulting reduction in veiling glare.

FIGS. 12, 14, and 15 show various trajectories for light 30 entering the bottom surface 45 of the windows. Ray 68 represents the path of light 30 that is absorbed by the blackening layer 41. Ray 70 is the path of light 30 that passes through the aperture 34 of the processed glass blank 36. In FIG. 12 ray 72 represents light 30 that is reflected off the conductive coating 64 due to the exposure of the conductive coating 64 by removal of the blackening layer in the resulting prior art prepared surface 44*a*. In FIG. 14 representing the present invention, ray 74 depicts light 30 that is absorbed by the blackening ring 62. Finally, in FIG. 15 ray 76 shows light 30 that is absorbed by the glare shield 66.

The present invention meets all of the design requirements by integrating an aperture and glare shield into the window structure as well as accommodating windows with parallel or stepped designs.

The foregoing disclosure and description of the invention are illustrative and explanatory thereof, and various changes in the size, shape and materials, as well as in the details of the illustrated construction may be made without departing from the spirit of the invention.

What is claimed is:

1. A faceplate for an image intensifier tube for reducing veiling glare, comprising:

a blackened blank of optical material of a desired glass composition having a shape that conforms substantially to a configuration of the faceplate to be produced includes processed opposing upper and bottom surfaces;

the processed upper surface of the glass blank being formed having a blackened ring about a light transmissive portion; the light transmissive portion of the processed upper surface being formed by removal of a blackened step portion extending from the upper surface; and, the processed bottom surface having substantially all blackening removed creating a desired aperture through the glass blank through which aperture light may pass.

2. The invention of claim 1 wherein the upper and lower surfaces are essentially parallel.

3. The invention of claim 1 wherein the upper and lower surfaces are flat.

* * * * *